US006921281B2

(12) United States Patent
Chen

(10) Patent No.: US 6,921,281 B2
(45) Date of Patent: Jul. 26, 2005

(54) STRUCTURE OF POWER LINE FIXING MODULE IN ELECTRONIC APPARATUS

(75) Inventor: Chun-Chen Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/676,021

(22) Filed: Oct. 2, 2003

(65) Prior Publication Data

US 2004/0185712 A1 Sep. 23, 2004

(30) Foreign Application Priority Data

Mar. 18, 2003 (TW) ..... 92204152 U

(51) Int. Cl.[7] ..... H01R 13/56
(52) U.S. Cl. ..... 439/447; 439/564; 439/906
(58) Field of Search ..... 439/564, 604, 439/447, 544, 573, 76.1, 578, 587; 174/50.54, 50.63, 52.2, 54, 55, 65 R, 65 G, 50.56

(56) References Cited

U.S. PATENT DOCUMENTS 3,357,421 A * 12/1967 Hatch ..... 76/866.5
3,447,332 A * 6/1969 Lemberg et al. ..... 62/645
3,768,064 A * 10/1973 Pabich ..... 439/370
4,117,257 A * 9/1978 Thomas ..... 174/52.1
4,449,776 A * 5/1984 Carmo et al. ..... 439/500
4,647,128 A * 3/1987 Maros ..... 439/350
5,073,046 A * 12/1991 Edwards et al. ..... 385/90
5,320,554 A * 6/1994 Freer et al. ..... 439/347
5,580,264 A * 12/1996 Aoyama et al. ..... 439/275
5,649,834 A * 7/1997 Allison et al. ..... 439/247
5,974,766 A * 11/1999 Weder ..... 53/397
6,346,007 B2 * 2/2002 Yokoi ..... 439/564
6,411,526 B1 * 6/2002 Nguyen et al. ..... 361/829
6,494,749 B1 * 12/2002 Chang ..... 439/701
6,497,589 B1 * 12/2002 Hutchinson et al. ..... 439/607
6,616,480 B2 * 9/2003 Kameyama ..... 439/587
6,814,616 B2 * 11/2004 Pade ..... 439/587
2001/0024907 A1 * 9/2001 Murakami et al. ..... 439/587
2002/0072273 A1 * 6/2002 Puettner et al. ..... 439/587

* cited by examiner

*Primary Examiner*—Tho D. Ta
*Assistant Examiner*—Larisa Tsukerman
(74) *Attorney, Agent, or Firm*—Bacon & Thomas

(57) ABSTRACT

A structure of a power line fixing module for an electronic apparatus. The structure includes an electronic-apparatus housing having a first side plate having a first fixing hole, a power line having a connector at one end thereof, a fixing medium cooperating with the connector of the power line for fixing the connector of the power line in the first fixing hole of the first side plate, and at least a fixing element for fixing the fixing medium on the first side plate.

13 Claims, 8 Drawing Sheets

STRUCTURE OF POWER LINE FIXING MODULE IN ELECTRONIC APPARATUS

FIELD OF THE INVENTION

This invention relates to a structure of a power line fixing module in an electronic apparatus, and more particular to a structure of a power line fixing module in a power adapter.

BACKGROUND OF THE INVENTION

The power adapter is an electronic apparatus used frequently in our daily life. Taking an adapter, a power adapter or a charger of an electric appliance as an example, it is generally employed for rectifying and converting the external AC power into the DC power, so as to supply the required power to the electric appliance, such as a notebook, or charge the charging battery.

Please refer to FIG. 1, which illustrates a schematic view of a conventional power adapter. As shown in FIG. 1, the conventional power adapter includes a metal extrusion housing 11, a first side plate 12, a second side plate 13, a power input element 14 and a power output element 15. The metal extrusion housing 11, the first side plate 12 and the second side plate 13 can be assembled by means of screws, and after assembling, they can provide a closed space for mounting a printed circuit board 16. Moreover, the first side plate 12 further includes a fixing hole 121 for mounting the power input element 14, wherein the power input element 14 is generally a socket which can be connected to the printed circuit board 16 through one end thereof and connected to a connector 171 of an external power line 17 through the other end thereof for inputting an external AC power to the printed circuit board 16. In addition, the power output element 15 can be mounted on the second side plate 13, wherein the power output element 15 is generally a power line to provide a rectified and converted direct current from the power adapter to the information appliance (not shown) for a directly use or charging the rechargeable battery.

Please further refer to FIG. 1. The first side plate 12, besides the fixing hole 121, further includes plural tap holes 122, and the lug of the power input element 14 further includes plural perforations 141 corresponding to plural tap holes 122. Therefore, when the power input element 14 is assembled in the fixing hole 121 of the first side plate 12, a screw 18 will pass through the perforation 141 of the lug of the power input element 14 and lock in the tap hole 122 of the first side plate 12 so as to fix the power input element 14 on the first side plate 12.

However, for conforming to the various standards and requests of every kind of power adapter, the power input element 14 of the power adapter should have different designs. Therefore, besides directly mounting the socket on the first side plate 12, the power line 17 can also be directly assembled on the first side plate 12 for avoiding a missing. But, on the presupposition of maintaining the whole frame of the power adapter (i.e. the frame of power adapter become standards) and saving the cost, the assembling method thereof will become difficult. Please refer to FIG. 2, which discloses the assembling difficulty of the conventional power adapter while the power line is directly fixed thereon. Generally, the power line 19 has two ends. One end is a plug 191 for connecting to the external alternating current, and the other end is a connector 192. The connector 192 includes a buffer portion 193, a first flanged ring 194, a second flanged ring 195 and a groove 196, wherein the groove 196 is positioned between the first flanged ring 194 and the second flanged ring 195. However, the cross section of the second flanged ring 195 is usually larger than that of the fixing hole 121 for engaging the groove 196 and sidewall of the fixing hole 121, so that the connector 192 of the power line 19 is difficult to wedge in the fixing hole 121 when assembling. Even if the cross section of the second flanged ring 195 is particularly designed to only slightly larger than that of the fixing hole 121 for wedging the connector 192 therein, the fixing and engaging effect therebetween might be therefore decreased to cause the connector 192 easily to depart therefrom. Thus, on the presupposition of maintaining the whole frame of the power adapter, saving the cost, and assembling easily, directly fixing the power line 19 on the first side plate 12 of the power adapter exists a difficulty when assembling.

Consequently, how to develop a structure of a power line fixing module for directly fixing the power line on the side plate of the power adapter without altering the whole structure of the power adapter, increasing the cost and increasing the assembling difficulty is an issue eager to be solved.

SUMMARY OF THE INVENTION

It is therefore an object of the present invention to provide a structure of a power line fixing module in an electronic apparatus so that the power line on the electronic apparatus can be easily assembled without altering the whole structure of the electronic apparatus and increasing the cost.

In accordance with a generalized aspect of the present invention, a structure of a power line fixing module for an electronic apparatus includes an electronic-apparatus housing comprising a first side plate having a first fixing hole, a power line having a connector at one end thereof, a fixing medium cooperating with the connector of the power line for fixing the connector of the power line in the first fixing hole of the first side plate, and at least a fixing element for fixing the fixing medium on the first side plate.

In accordance with another aspect of the present invention, a structure of a power line fixing module for an electronic apparatus is provided, wherein the electronic apparatus comprises a housing, and the housing comprises a first side plate having a first fixing hole. The structure includes a power line having a connector at an end thereof, a fixing medium cooperating with the connector of the power line for fixing the connector of the power in the first fixing hole of the first side plate, and at least a fixing element for fixing the fixing medium on the first side plate.

In accordance with another further aspect of the present invention, a structure of a power line fixing module in a power adapter includes a first side plate having a first fixing hole, a second side plate, a metal extrusion housing assembled with the first side plate and the second side plate to form a closed space for mounting a printed circuit board, a power line having a connector at one end thereof, a fixing medium cooperating with the connector of the power line for fixing the connector of the power line in the first fixing hole of the first side plate, and at least a fixing element for fixing the fixing medium on the first side plate.

The above objects and advantages of the present invention will become more readily apparent to those ordinarily skilled in the art after reviewing the following detailed descriptions and accompanying drawings, in which:

BRIEF DESCRIPTION OF THE DRAWINGS

FIG. 4(*b*) shows an assembling schematic view of a fixing medium in FIG. 3 according to the present invention;

DETAILED DESCRIPTION OF THE PREFERRED EMBODIMENT

The present invention provides a structure of a power line fixing module suitable for an electronic apparatus, for example, a power adapter, a power supply, a charger, a household appliance, and an information appliance etc., so that the manufacturer or assembler can directly fix the power line on the electronic apparatus by a cost-saving and easy-assembling method without altering the whole frame thereof.

Figure 1:
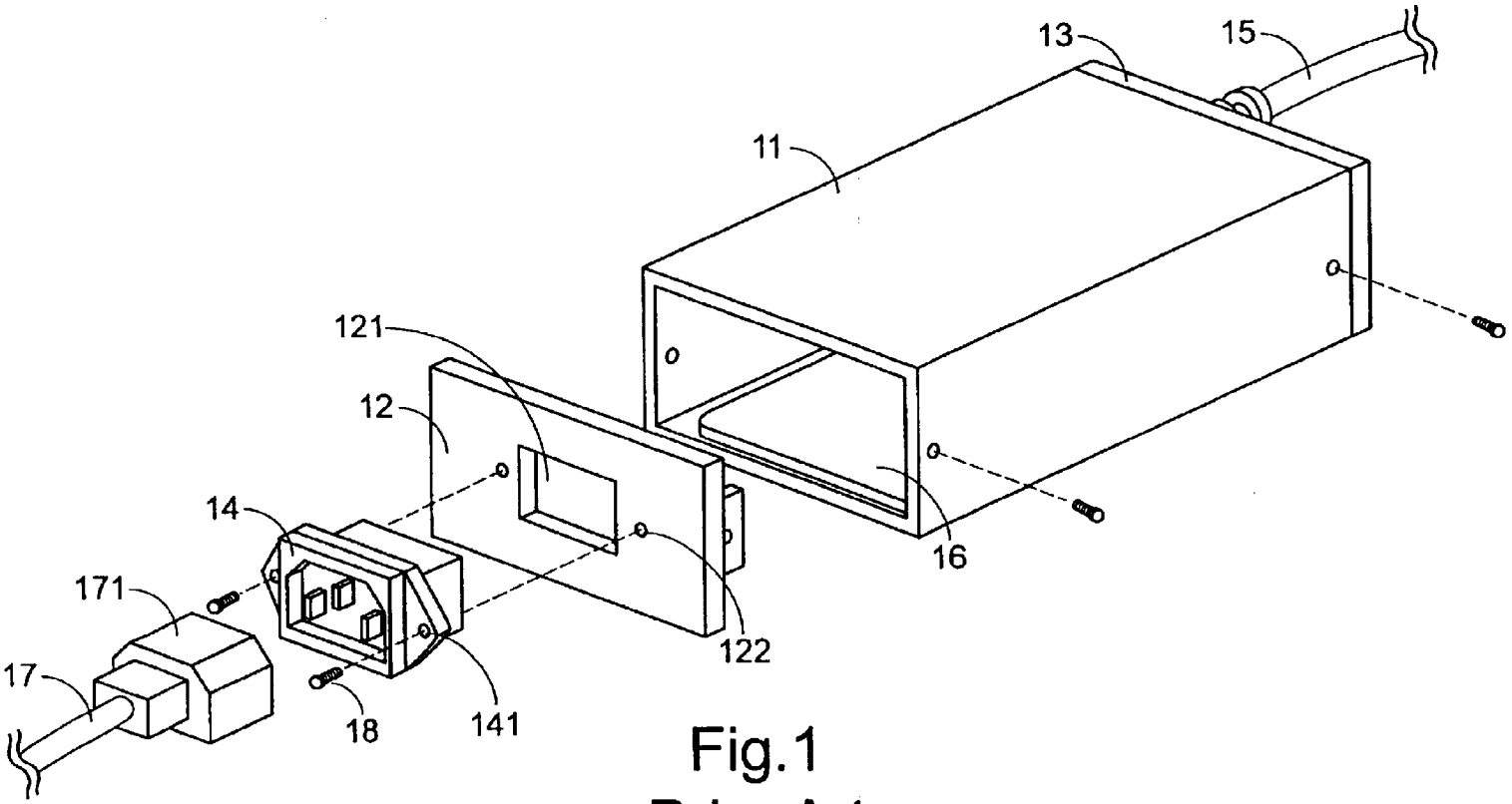
Fig. 1 Prior Art
FIG. 1 shows an assembling schematic view of a conventional power adapter.
Figure 2:
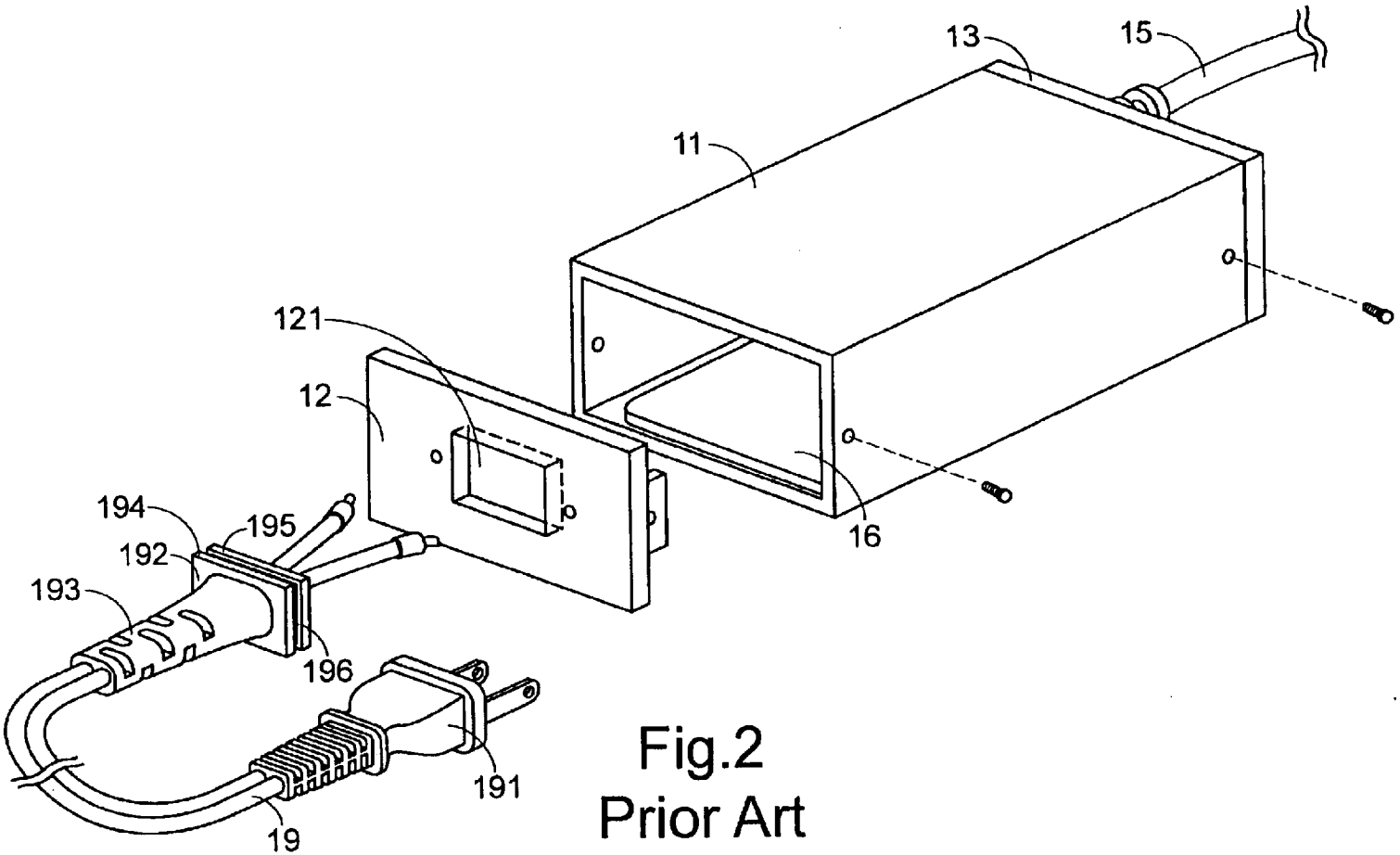
Fig.2 Prior Art
FIG. 2 shows the assembling difficulty of the conventional power adapter while the power line is directly fixed thereon.
Figure 3:
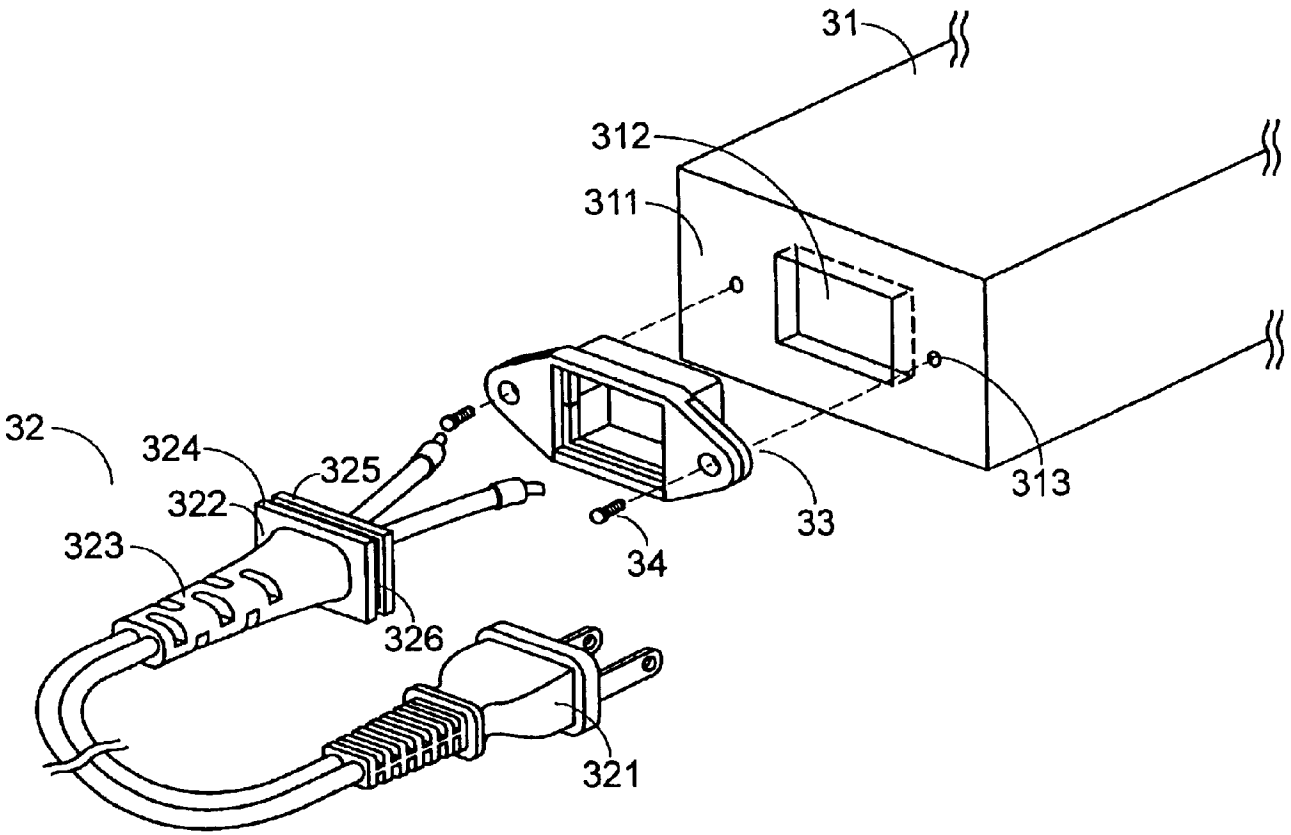
FIG. 3 shows an exploded diagram of a power line fixing module in an electronic apparatus according to the present invention.

Please refer to FIG. 3, which illustrates a schematic view of a power line fixing module of an electronic apparatus according to the present invention. As shown in FIG. 3, the power line fixing module of the electronic apparatus according to the present invention includes an electronic-apparatus housing 31, a power line 32, a fixing medium 33 and at least a fixing element 34. The electronic-apparatus housing 31 includes a first side plate 311 having a first fixing hole 312. The power line 32 has two ends, wherein one end is a plug 321 for electrically connecting to an external AC power source, and the other end is a connector 322 for electrically connecting to a printed circuit board (not shown) positioned in the electronic apparatus. Furthermore, the fixing medium 33 can be assembled with the connector 322 of the power line 32 and also can be departed from the connector 322 so that the connector 322 of the power line 32 can be fix in the first fixing hole 312 of the first side plate 311 and the fixing element 34 can fix the fixing medium 33 on the first side plate 311. Consequently, the power line 32 therefore can be directly fixed on the electronic-apparatus housing 31.

Please further refer FIG. 3. The connector 322 of the power line 32 includes a buffer portion 323, a first flanged ring 324, a second flanged ring 325 and a groove 326. The groove 326 is formed between the first flanged ring 324 and the second flanged ring 325, and the cross sections of the first flanged ring 324 and the second flanged ring 325 are substantially identical. Moreover, the connector 322 further includes plural connecting lines extending from one side of the second flanged ring 325 for connecting to the printed circuit board by welding.

Figure 4A:
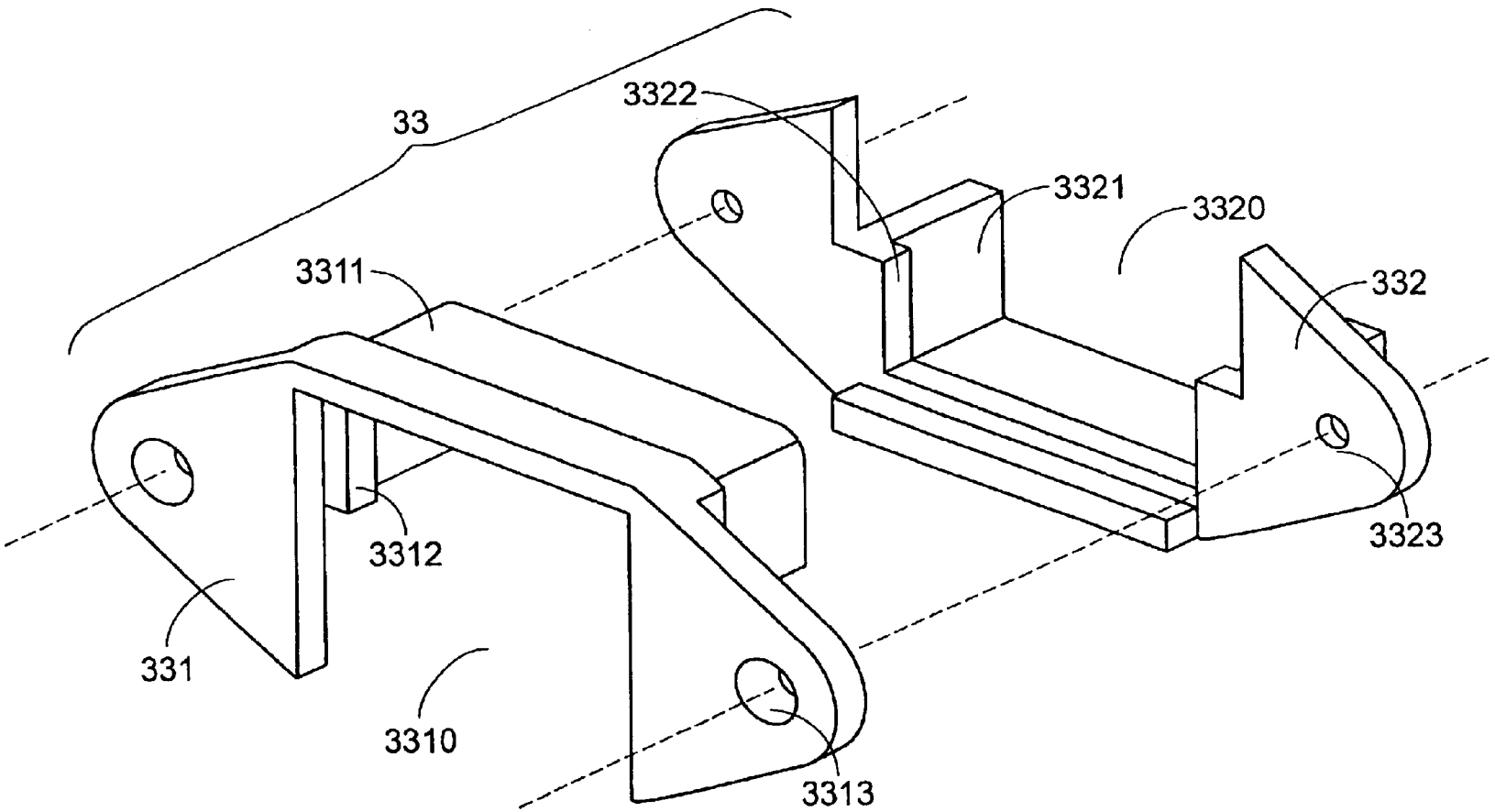
FIG. 4(*a*) shows an exploded diagram of a fixing medium in FIG. 3 according to the present invention.
Figure 4B:
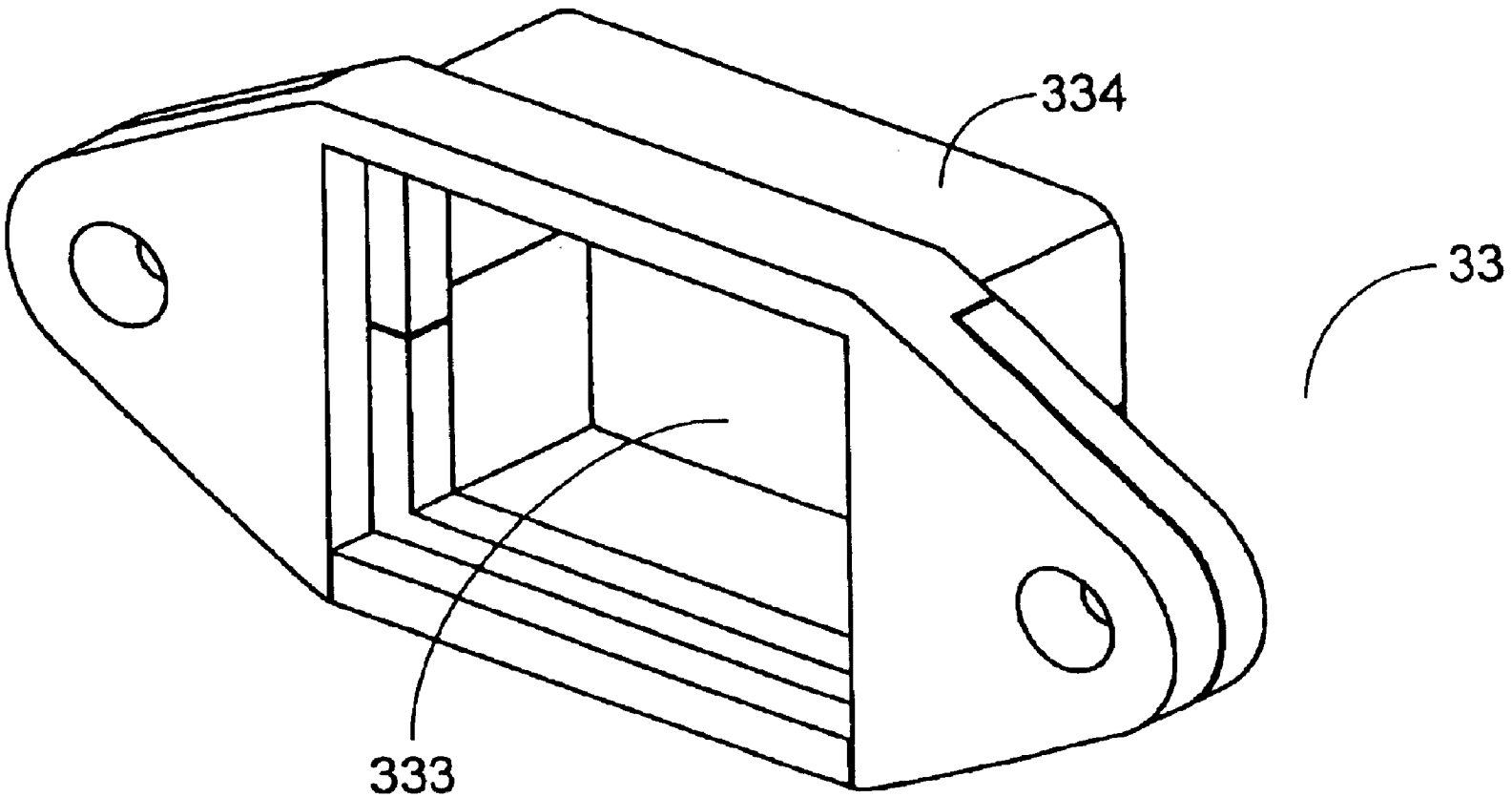

Please refer to FIGS. 4(*a*)~4(*b*), which respectively show an exploded diagram and an assembling schematic view of the fixing medium in FIG. 3. As shown in FIG. 4(*a*), the fixing medium 33 includes a first fixing plate 331 and a second fixing plate 332. The first fixing plate 331 includes a first opening 3310, a first extending plate 3311 and a first flange rib 3312, wherein the first extending plate 3311 is perpendicularly extended from a portion of an edge area of the first opening 3310, and the first flange rib 3312 is formed inside the first extending plate 3311. Furthermore, the second fixing plate 332 includes a second opening 3320, a second extending plate 3321 and a second flange rib 3322, wherein the second extending plate 3321 is perpendicularly extended from a portion of an edge area of the second opening 3320, and the second flange rib 3322 is formed inside the second extending plate 3321. Additionally, the first fixing plate 331 further includes at least a first perforation 3313, and the second fixing plate 332 further includes at least a second perforation 3323, wherein the second perforation 3323 is corresponding to the first perforation 3313.

As shown in FIG. 4(*b*), when the first fixing plate 331 and the second fixing plate 332 are assembled together, the first opening 3310 and the second opening 3320 will cooperate with each other to form a second fixing hole 333 for mounting the connector 322 of the power line 32. Besides, the first extending plate 3311 and the second extending plate 3321 will also cooperate with each other to form a circular extending portion 334 whose cross section is approximately identical to that of the first fixing hole 312 of the first side plate 311.

Figure 5:
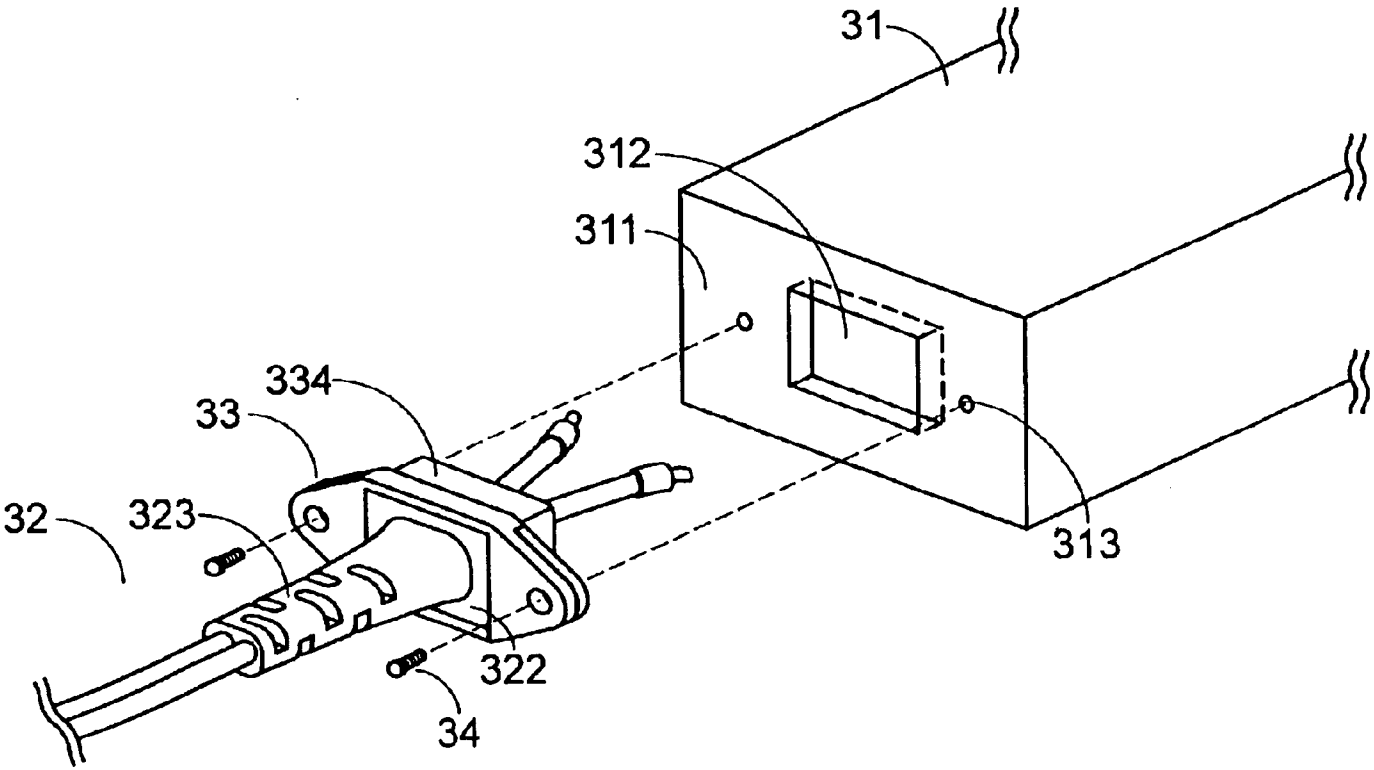
FIG. 5 shows an assembling schematic view of a power line fixing module in an electronic apparatus according to the present invention.

Please refer to FIG. 5. When the fixing medium 33 is assembled with the connector 322 of the power line 32 (namely the first fixing plate 331, the second fixing plate 332 and the connector 322 of the power line 32 are assembled together), the first flange rib 3312 and the second flange rib 3322 will simultaneously lodge in the groove 326 for allowing the first flanged ring 324 and the second flanged ring 325 of the connector 322 to be disposed at the two sides of the first flange rib 3312 and of the second flange rib 3322. Because the cross sections of the first flanged ring 324 and the second flanged ring 325 of the connector 322 are approximately identical to each other, after assembling, the connector 322 can be tightly mounted in the second fixing hole 333.

When the connector 322 of the power line 32 and the fixing medium 33 are assembled together, the circular extending portion 334 which is assembled by the first extending plate 3311 and the second extending plate 3321 can be positioned in the first fixing hole 312 of the first side plate 311. Because the cross section of the circular extending portion 334 is identical to that of the first fixing hole 312, the assembled connector 322 and fixing medium 33 can be tightly mounted in the first hole 312. For more securely fixing the connector 322 and the fixing medium 33 in the first side plate 311, at least a fixing element 34 can be employed to pass through the first perforation 3313 of the first fixing plate 331 and the second perforation 3323 of the second fixing plate 332 and lock in a tap hole 313 of the first side plate 311 so that the fixing medium 33 can be steadily fixed on the first side plate 311.

Figure 6:
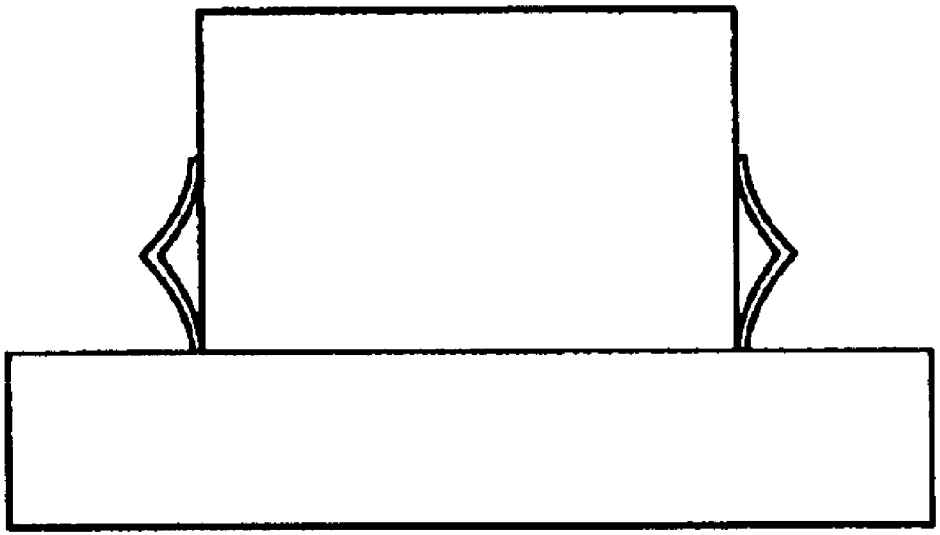
FIG. 6 shows a top view of a fixing medium which employs an elastic locking-piece as a fixing element according to the present invention.

In the preferred embodiment described above, the fixing element 34 is preferably a screw. Certainly, the fixing element 34 can be a tenon or an elastic locking-piece, etc. As shown in FIG. 6 which illustrates a structural top view of the fixing medium which employs the elastic locking-piece as a fixing element. When the fixing element 34 is an elastic locking-piece, it can be selectively mounted on an outside of the first extending plate 3311 of the first fixing plate 331 and/or an outside of the second extending plate 3321 of the second fixing plate 332. Therefore, when the circular extending portion 334 which is assembled by the first extending plate 3311 and the second extending plate 3321 is mounted in the first hole 312 of the first side plate 311, the elastic locking-piece will bias against a sidewall of the first fixing hole 312 so as to fix the fixing medium 33 tightly in the fixing hole 312.

Figure 7:
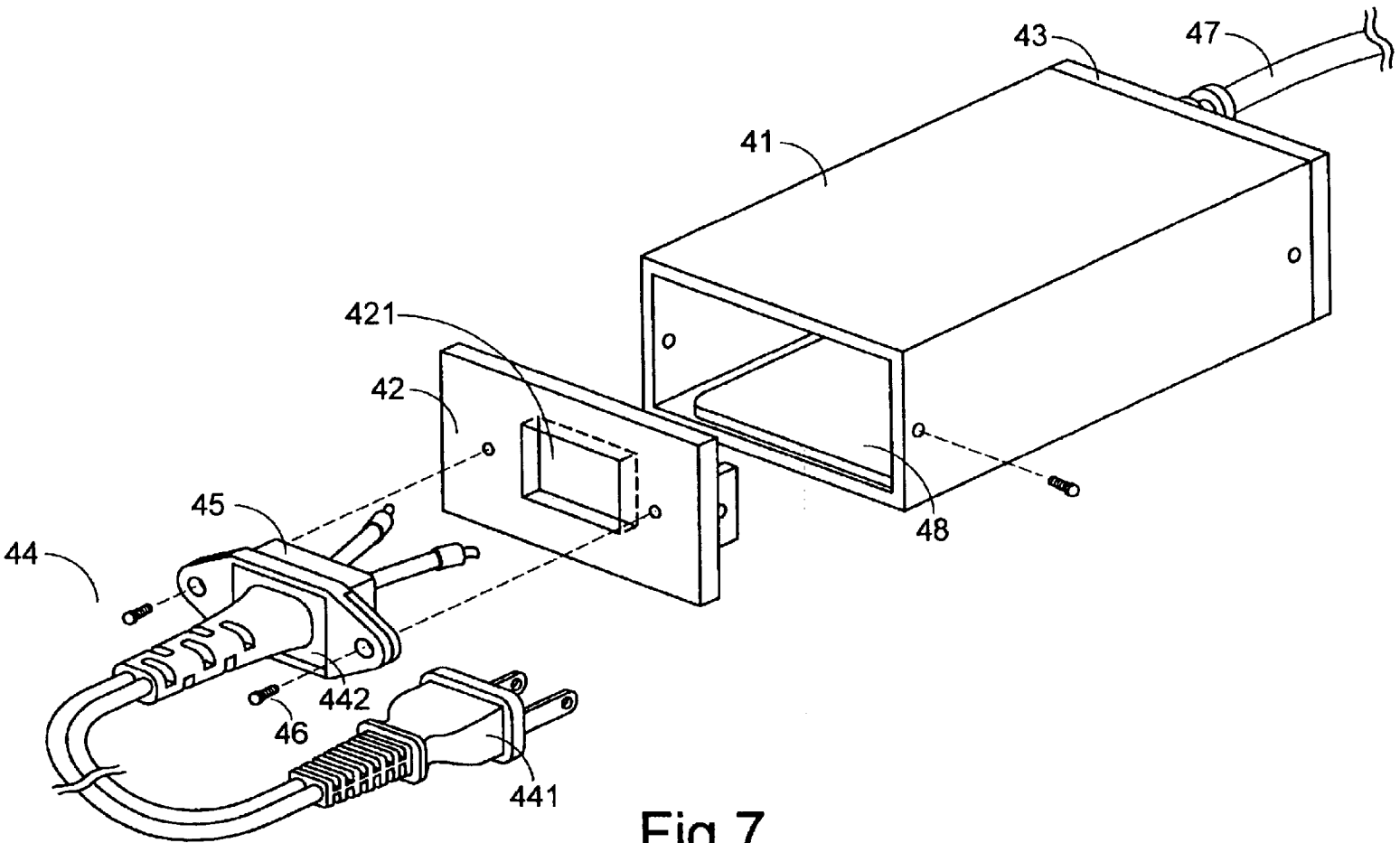
FIG. 7 shows a schematic view of a power line fixing module applied in a power adapter according to the present invention.

Please refer to FIG. 7, which illustrates a schematic view of a power line fixing module applied in a power adapter according to the present invention. In this embodiment, the power adapter includes a metal extrusion housing 41, a first side plate 42, a second side plate 43, a power line 44, a fixing medium 45, at least a fixing element 46, a power output element 47 and a printed circuit board 48. The metal extrusion housing 41 can be assembled with the first side plate 42 and the second side plate 43 by means of a screw so as to provide a closed space for positioning the printed circuit board 48. Moreover, the power line 44 has two ends, wherein one end thereof is a plug 441 for connecting to the external AC power source, and the other end thereof is a connector 442 for electrically connecting to the printed circuit board 48 in the power adapter by welding. The fixing medium 45 can be detachably assembled with the connector 442 of the power 44 for fixing the connector 442 of the power line 44 in the first fixing hole 421 of the first side plate 42. And, the fixing element 46 can be employed to fix the fixing medium 45 on the first side plate 42. Through all these structures described above, the power line 44 can be directly fixed on the first side plate 42 of the power adapter. Otherwise, the power output element 47 can be mounted on the second side plate 43, and the power output element 47 is generally a power line for providing a DC power which is rectified and converted by the power adapter to the information appliance for a directly use or charging the rechargeable battery. Certainly, in this embodiment, the power line 44, the fixing medium 45 and the fixing element 46 all have the same structures as described in the previous embodiments and will not give an unnecessary detail.

In the aforesaid, the present invention provides a structure of a power line fixing module suitable for an electronic apparatus so that the power line can be directly assembled on the electronic apparatus by a cost-saving and easy-assembling method without altering the whole frame thereof. Consequently, the present invention owns industrial values.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. A structure of a power line fixing module for an electronic apparatus, comprising:

an electronic-apparatus housing comprising a first side plate having a first fixing hole;

a power line having a connector at one end thereof;

a fixing medium cooperating with said connector of said power line for fixing said connector of said power line in said first fixing hole of said first side plate;

at least a fixing element for fixing said fixing medium on said first side plate;

said connector of said power line comprises a first flanged ring, a second flanged ring and a groove, wherein said groove is positioned between said first flanged ring and said second flanged ring; and said fixing medium comprises a first fixing plate having a first opening, a first extending plate and a first flange rib, wherein said first extending plate is perpendicularly extended from a portion of an edge area of said first opening, and said first flange rib is formed inside said first extending plate, and a second fixing plate having a second opening, a second extending plate and a second flange rib, wherein said second extending plate is perpendicularly extended from a portion of an edge area of said second opening, and said second flange rib is formed inside said second extending plate.

2. The structure according to claim 1, wherein said first opening and said second opening are cooperated to form a second fixing hole for mounting said connector of said power line when said first fixing plate, said second fixing plate and said connector are assembled together, said first flange rib and said second flange rib are lodged in said groove of said connector, and said first extending plate and said second extending plate are cooperated to form a circular extending portion of said fixing medium.

3. The structure according to claim 2, said first flanged ring and said second flanged ring have an identical cross section to said second fixing hole, and said circular extending portion of said fixing medium has an identical cross section to said first fixing hole.

4. The structure according to claim 1, wherein said first fixing plate comprises at least a first perforation, and said second fixing plate comprises at least a second perforation corresponding to said first perforation.

5. The structure according to claim 4, wherein said first side plate further comprises at least a tap hole.

6. The structure according to claim 5, wherein said fixing element is a screw for passing through said first perforation of said first fixing plate and said second perforation of said second fixing plate and locking in said tap hole of said first plate so as to fix said fixing medium on said first side plate.

7. The structure according to claim 1, wherein said fixing element is an elastic locking-piece mounted on an outside of said first extending plate of said first fixing plate and/or an outside of said second extending plate of said second fixing plate.

8. A structure of a power line fixing module in a power adapter, comprising:

a first side plate having a first fixing hole;

a second side plate;

a metal extrusion housing assembled with said first side plate and said second side plate to form a closed space for mounting a printed circuit board;

a power line having a connector at one end thereof;

a fixing medium cooperating with said connector of said power line for fixing said connector of said power line in said first fixing hole of said first side plate;

at least a fixing element for fixing said fixing medium on said first side plate;

said connector of said power line comprises a first flanged ring, a second flanged ring and a groove, wherein said groove is positioned between said first flanged ring and said second flanged ring; and said fixing medium comprises a first fixing plate having a first opening, a first extending plate and a first flange rib, wherein said first extending plate is perpendicularly extended from a portion of an edge area of said first opening, and said first flange rib is formed inside said first extending plate, and a second fixing plate having a second opening, a second extending plate and a second flange rib, wherein said second extending plate is perpendicularly extended from a portion of an edge area of said second opening, and said second flange rib is formed inside said second extending plate.

9. The structure according to claim 8, wherein said first opening and said second opening are cooperated to form a second fixing hole for mounting said connector of said power line when said first fixing plate, said second fixing plate and said connector are assembled together, said first flange rib and said second flange rib are lodged in said groove of said connector, and said first extending plate and said second extending plate are cooperated to form a circular extending portion of said fixing medium.

10. The structure according to claim 9, wherein said first flanged ring and said second flanged ring have an identical cross section to said second fixing hole, and said circular extending portion of said fixing medium has an identical cross section to said first fixing hole.

11. The structure according to claim 8, wherein said first fixing plate comprises at least a first perforation and said second fixing plate comprises at least a second perforation corresponding to said first perforation.

12. The structure according to claim 11, wherein said first side plate further comprises a tap hole, and said fixing element is a screw for passing through said first perforation of said first fixing plate and said second perforation of said second fixing plate and locking in said tap hole of said first side plate so as to fix said fixing medium on said first plate.

13. The structure according to claim 8, wherein said fixing element is an elastic locking-piece mounted on an outside of said first extending plate of said first fixing plate and/or an outside of said second extending plate of said second fixing plate.

* * * * *